United States Patent [19]

Sato et al.

[11] 4,388,676

[45] Jun. 14, 1983

[54] LIGHTING DEVICE

[75] Inventors: Koji Sato, Yokohama; Tadahiro Kaneko, Tokyo, both of Japan

[73] Assignee: Toshiba Electric Equipment Corporation, Tokyo, Japan

[21] Appl. No.: 213,025

[22] Filed: Dec. 4, 1980

[30] Foreign Application Priority Data

Dec. 17, 1979 [JP] Japan ..... 54-163919

[51] Int. Cl.[3] ..... F21V 13/00

[52] U.S. Cl. ..... 362/260; 362/33; 362/223

[58] Field of Search ..... 362/33, 89, 147, 217, 362/223, 260, 296, 307, 311, 341, 347, 132, 134

[56] References Cited

U.S. PATENT DOCUMENTS 3,389,246 6/1968 Shemitz .
4,173,034 10/1979 Shemitz ..... 362/33
4,300,185 11/1981 Wakamatsu ..... 362/33

OTHER PUBLICATIONS

A New Concept for Better Lighting and Power Utilization by Hentschel et al., from the Seimens Review XLV (1978), No. 11, pp. 507–510.
"Editorial" from Interior, Sep. 1975, pp. 87–97.

*Primary Examiner*—Donald P. Walsh

*Attorney, Agent, or Firm*—Oblon, Fisher, Spivak, McClelland & Maier

[57] ABSTRACT

A straight cylindrical light source formed of, for example, a fluorescent lamp is set in place at a predetermined distance from a desk top surface. A reflector whose cross section is shaped substantially like a parabola is positioned at the back of the light source. A housing having an opening formed at least on the underside is provided to enclose the light source and reflector. Where a vertical angle defined by a straight line $l_0$ connecting the axis of the light source to the front edge of the desk top surface defines $\theta_0$, then a vertical angle $\theta_1$ defined by a straight line $l_1$ tangentially contacting the upper peripheral surface of the cylindrical light source and extending to the front end of the lower opening of the housing is also prescribed to be substantially $\theta_0$. A vertical angle $\theta_2$ defined by a straight line $l_2$ passing through the upper terminal end of the reflector and tangentially contacting the lower peripheral surface of the cylindrical light source is also chosen to be substantially $\theta_0$. The reflector is so positioned that the focal point of its parabolic cross section is substantially aligned with the axis of the light source, and a vertical angle $\theta_3$ defined by a straight line $l_3$ extending along the axis of the parabolic cross section of the reflector is likewise taken to be $\theta_0$.

10 Claims, 5 Drawing Figures

LIGHTING DEVICE

BACKGROUND OF THE INVENTION

1. Field of the Invention

This invention relates to a lighting device and more particularly to a lighting device capable of emitting a light over a desk top surface with substantially uniform illuminance.

2. Description of the Prior Art

A conventional lighting device disclosed, for example, in the U.S. Pat. No. 4,054,793 has a light source and reflector set in a housing provided with an illumination opening. This type of lighting device is so constructed as to cause a light to be emitted over, for example, the top of an office desk. The illumination opening is provided with a transparent light-refracting plate whose inner wall is cut in the form of a series of prisms or in the knurled form. This light-refracting plate indeed prevents veiling reflection of a light. With the lighting device of the above-mentioned U.S. Pat. No. 4,054,793, however, a reflector disposed at the back of a light source is designed to reflect a light flux from the source only downwardly, causing the desk top surface to be irregularly illuminated. In other words, the proposed lighting device has a drawback in that the portion of the top surface of an office desk which lies near a lighting device is more brightly illuminated, whereas that portion of the desk top surface which lies remote from the lighting device receives a smaller amount of light; namely, that region of the desk top surface which lies immediately in front of the user working with such desk gets darker. If it is desired to eliminate the darkness in front of the user, then it will be necessary to provide a light source device capable of emitting a brighter light. This means that the resultant lighting device will consume more electric power, be increased in size and obstruct the user's front view.

SUMMARY OF THE INVENTION

It is accordingly the object of this invention to provide a lighting device capable of illuminating a desk top surface with substantially uniform illuminance without being oversized or bulky.

To attain the above mentioned object, this invention provides a lighting device which comprises an elongated housing, a straight cylindrical light source received in the housing and a reflector which has a parabolic cross section. The lighting device is set above one of mutually parallel edges of the desk top, and the housing has an opening facing at least a desk top surface. A vertical angle defined by a line connecting the axis of the light source to the other edge of the desk top is denoted by $\theta_0$. Then a vertical angle defined by the reflector axis is chosen to be substantially $\theta_0$, a vertical angle defined by a straight line passing through the upper edge of the reflector and tangentially contacting the lower peripheral surface of the light source is taken to be substantially $\theta_0$. Further a vertical angle defined by a straight line passing through one end of the opening and tangentially contacting the upper peripheral surface of the light source is prescribed to be substantially $\theta_0$.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
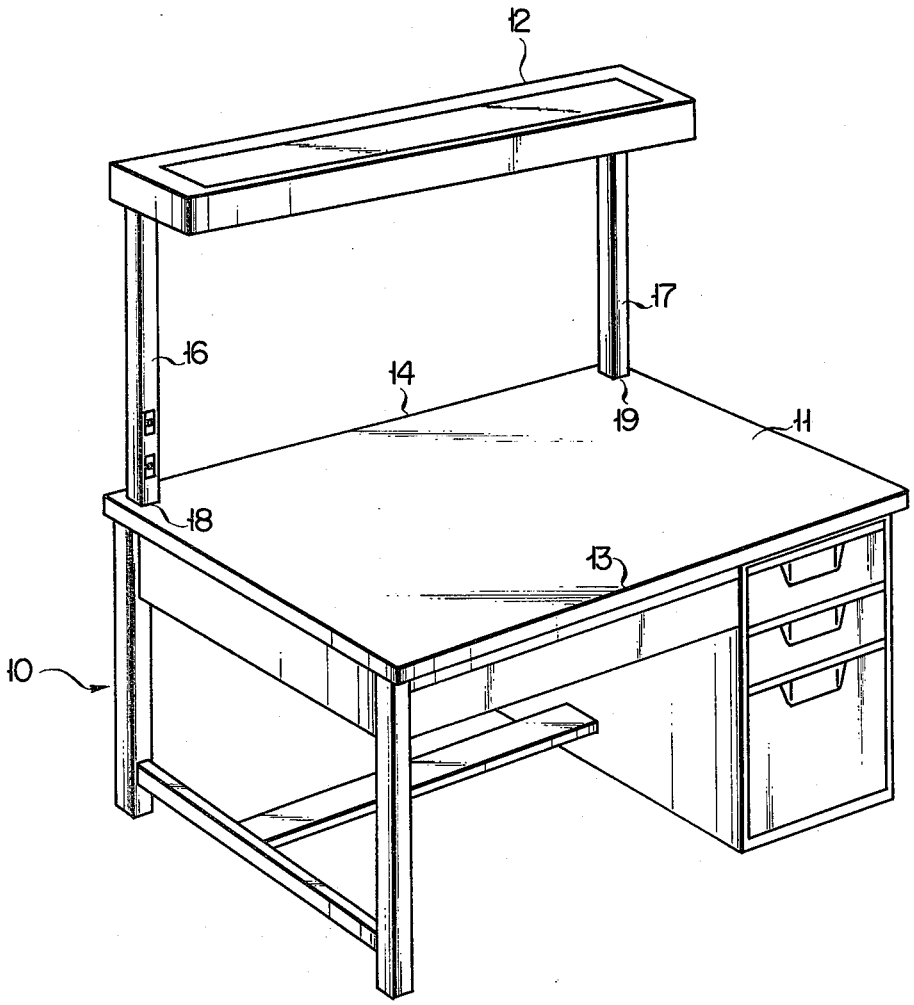
FIG. 1 is an oblique view of the whole of a lighting device embodying the invention which is fitted to desk.

According to an embodiment of this invention shown in FIG. 1, mounted above a top surface 11 of desk 10 is a lighting device 12 which illuminates the top surface of the desk (hereinafter simply referred to as "desk top surface"). The desk top surface 11 includes a side edge (hereinunder referred to as "front edge") 13 and a back side edge (hereinafter referred to as "rear edge") 14. The lighting device 12 is fixed by a pair of pole braces 16, 17 at the rear edge 14. The paired pole braces 16, 17 are inserted at the lower end into fitting holes 18, 19 provided at both ends of the rear edge portion of the desk 10 to be fixed in place by screws (not shown). The lighting device 12 is fitted to the upper end of each pole brace 16, 17.

Figure 2:
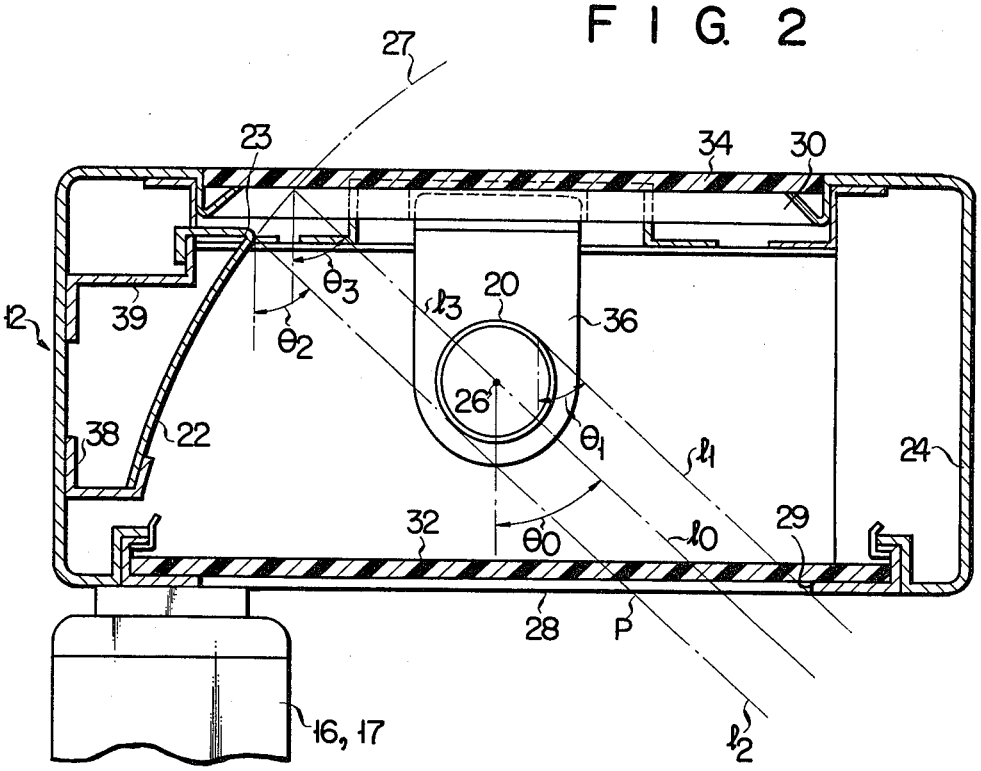
FIG. 2 is an enlarged sectional view, partly in section, of the lighting device of FIG. 1.

As shown in enlargement in FIG. 2, the lighting device 12 comprises a light source 20 (for example, a straight tubular fluorescent lamp), a reflector 22 having an upper terminal end 23 and a housing 24 enclosing the light source 20 and the reflector 22. As shown in FIG. 2, the light source 20 has a cross sectional center 26 corresponding to the axis of the straight tubular fluorescent lamp (hereinafter referred to as "central point" of the light source 20). The cross section of the reflector 22 is shaped substantially like a parabola whose focal point is constituted by the central point 26 of the light source 20. That portion of the inner wall of the reflector 22 which faces at least the light source 20 is mirror-treated to ensure the efficient reflection of light beams emitted from the light source 20. The housing 24 has, for example, an elongated rectangular shape corresponding to the length of the straight tubular light source 20. An opening 28 is provided on that side of the housing 24 which faces the desk top surface 11, that is, the underside of the housing 24. An opening 30 is formed on the opposite side or upper side of the housing 24. The opening 28 provided in the underside of the housing 24 (hereinafter referred to as "lower opening") is fitted with a transparent cover 32 prepared from, for example, transparent resinous material which does not disturb the distribution of luminous intensity of light beams emitted from the light source 20 or reflected from the reflector to the desk top surface 11. The provision of the transparent cover 32 is intended to improve the external appearance of the light source 20 and prevent it from being soiled with, for example, dust. The opening 30 formed on the upper side of the housing 24 (hereinafter referred to as "upper opening") is fitted with, for example, a milky white cover 34 to properly restrict the upward emission of a light from the light source toward the room ceiling. The light source 20 is fitted into two lamp sockets 36 (only one shown in FIG. 2) provided in the inner wall of the housing 24, and connected to an A.C. power source through, for example, a reactance ballast, power switch and glow starter, etc. (not shown). The reflector 22 is tightly fitted to the inner wall of the housing 24 by attachments 38, 39.

Figure 3:
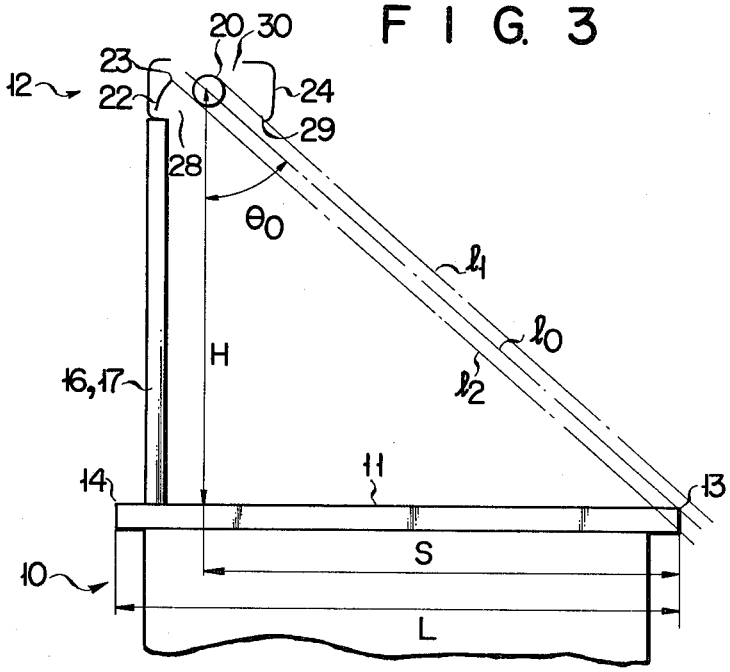
FIG. 3 is a fractional sectional view of the lighting device of FIG. 1.

Description is now given with reference to FIGS. 2 and 3 of the relative positions of the light source 20, the reflector 22 and the lower opening 28 of the housing 24. As seen from FIG. 3, the light source 20 is set above the desk top surface 11 at a height H, such that a line $l_0$ connecting the central point 26 (FIG. 1) of the light source 20 to the front edge 13 of the desk top surface 11 (hereinafter referred to as "reference line") defines a predetermined vertical angle $\theta_0$ (hereinafter referred to as "reference vertical angle") with at least one of vertical lines drawn toward the desk top surface 11. The front end 29 of the lower opening 28 is so positioned that a first line $l_1$ connecting the upper surface of the light source 20 to the front end 29 of the lower opening 28 of the housing 24 defines a vertical angle $\theta_1$ substantially equal to the reference vertical angle $\theta_0$. This reference vertical angle $\theta_0$ is, in this case, generally chose to be approximately 45° in consideration of the interrelationship between the upper terminal end 23 of the reflector 22, the ordinary standard size (for example S=600 mm) of an office desk and a standard height (for example H=620 mm) at which a lighting device is mounted above the desk top surface 11. In practice, however, the above-mentioned reference vertical angle $\theta_0$ is preferred to be 45°±10° in anticipation of variations in the size of an office desk and/or errors in the fitting of the reflector 22 while an office desk is assembled in a maker's plant. The vertical angle $\theta_1$ is most preferred to be equal to the reference vertical angle $\theta_1$. In practice, however, the front end 29 of the lower opening 28 of the housing 24 is so positioned as to define $\theta_1=\theta_0\pm10°$. The upper terminal end 23 of the reflector 22 is so set as to cause the vertical angle $\theta_2$ defined by the second line $l_2$ to indicate also $\theta_2=\theta_0\pm10°$. The reflector 22 is inclined to the desk top surface 11 such that the vertical angle $\theta_3$ defined by the third line $l_3$ (FIG. 2) corresponding to the principal axis of the parabola 27 denoting the cross section of the reflector 22 similarly indicate $\theta_3=\theta_0\pm10°$. Further, the reflector 22 is so set in the housing 24 that the vertical angle $\theta_2$ defined by the second line $l_2$ tangentially contacting the lower side of the peripheral surface of the light source 20 which faces the desk top surface 11 is also prescribed to be $\theta_0\pm10°$. At this time, the vertical angle $\theta_3$ defined by the third line $l_3$ extending along the principal axis of the parabola 27 denoting the cross section of the reflector 22 is also chosen to be $\theta_0\pm10°$. As shown in FIG. 3, the reference vertical angle $\Theta_0$ may be expressed as $$\tan\theta_0=S/H$$

where:

H=a perpendicular distance between the center of the light source and the desk top surface 11

S=a distance between a point at which a vertical line passing through the center of the light source 20 intersects the desk top surface 11 at right angles and the front edge 13 of the desk top surface 11

The third line $l_3$ is substantially aligned with the first line $l_1$. In other words, the reflector 22 is so set in the housing 24 that its inner reflection wall faces the front edge 13 of the desk top surface 11.

An explanation is now given with reference to FIG. 3 why allowable errors occurring in the vertical angle $\theta_1$ defined by the first line $l_1$ are chosen to fall within the range of ±10°. Where, for example, the rectangular housing 24 has a small crosswise length, then the front end 29 of the lower opening 28 of the housing 24 is drawn near to the paired pole braces 16, 17. As a result, a vertical angle $\theta_1$ defined by the line $l_1$ connecting the upper peripheral surface of the light source 20 to the shifted front edge 13 of the lower opening 28 becomes smaller than the reference vertical angle $\theta_0$. At this time, part of a light emitted from the light source 20 to the desk top surface 11 is obstructed by the shifted front end 29 of the lower opening 28. Theoretically, therefore, that portion of the desk top surface 11 which lies near the front edge 13 decreases to illuminance in a degree corresponding to that amount of a light flux which is obstructed by the shifted front end 29. Where the shifted front end 29 comes into a light path defined between the lines $l_1$ and $l_2$, and a light path whose width corresponds to over one-fourth of the diameter of the tubular light source 20 is obstructed by the front end 29, then that portion of the desk top surface 11 which lies near the front edge 13 is noticeably reduced in illuminance. Where, however, the portion of the width of the aforesaid light path which is obstructed by the shifted front end 29 corresponds to less than one-fourth of the diameter of the tubular light source 20, then that portion of the desk top surface 11 which lies near the front edge 13 is not reduced in illuminance. Consequently, a lower limit of −10° is derived for the vertical angle $\theta_1$ defined by the line $l_1$. This lower limit corresponds to a light path whose width measures one-fourth of the diameter of the tubular light source 20. Conversely where the crosswise length of the housing 24 is extended, then the vertical angle $\theta_1$ defined by the first line $l_1$ grows larger than the reference vertical angle $\theta_0$, causing a larger light flux to be emitted to the user. At this time, a larger light flux is directed only to the user himself, but a light flux irradiated on the desk top surface 11 does not increase in amount. Thus the illumination characteristic on the desk top surface 11 may not be advanced. Moreover, in this case, the housing 24 undesirable increases in size. For the reason given above, an upper limit to the vertical angle $\theta_1$ defined by the line $l_1$ is chosen to be +10° in anticipation of variations or errors in the fitting of a lighting device in assembling an office desk.

Explanation is now given as to why an allowable range of errors in the vertical angle $\theta_2$ defined by the second line $l_2$ is prescribed to be ±10°. Where the reflector 22 decreases in height, the upper terminal end 23 of the reflector 22 is lowered. As a result, the vertical angle $\theta_2$ defined by the second line $l_2$ connecting the lowered upper terminal end 23 to the lower peripheral surface of the tubular light source 20 grows larger than the reference vertical angle $\theta_0$. At this time, a light flux directed to the front edge 13 of the desk top surface 11 is not produced, namely, an undesirable dark region arises between a light flux emitted from the lower peripheral surface of the tubular light source 20 to the proximity of the front edge 13 of the desk top surface 11 and a light flux sent forth from the light source 20, and reflected from the proximity of the upper terminal end 23 of the reflector 22 to the neighborhood of the front edge 13 of the desk top surface 11. In other words, a light flux is not produced which passes through the proximity of point P (FIG. 2) of the lower opening 28 to the front edge 13 of the desk top surface 11. Theoretically, therefore a, decrement arises in illuminance in the proximity of the front edge 13 of the desk top surface 11 to an extent corresponding to the above-mentioned decrease in light flux. Actually, however, only where the height of the reflector 22 falls below four-fifths of the prescribed level, is significant reduction in illuminance observed on the desk top surface 11. In other words, as long as the reflector 22 is set at a greater height than four-fifths of the optimum levels, no noticeable loss of brightness actually takes place, even if the reflector is set at a reduced height. Therefore, an upper allowable limit of $+10°$ is derived for the vertical reference angle $\theta_2$ defined by the second line $l_2$ contacting the upper terminal end 23 of the reflector 22. Conversely where the reflector 22 is set at a greater height than that preferred, light reflected from the raised reflector 22 is brought back to the light source 20, thereby preventing luminous intensity at the front edge 13 of the desk top surface 11 from being elevated. Moreover, in this case, the housing 24 undesirable increases in height. For this reason, a lower allowable limit of $-10°$ should be imposed on the vertical angle $\theta_2$ by the second line $l_2$ in anticipation of variations or errors in the fitting of a lighting device in assembling an office desk.

Figure 4:
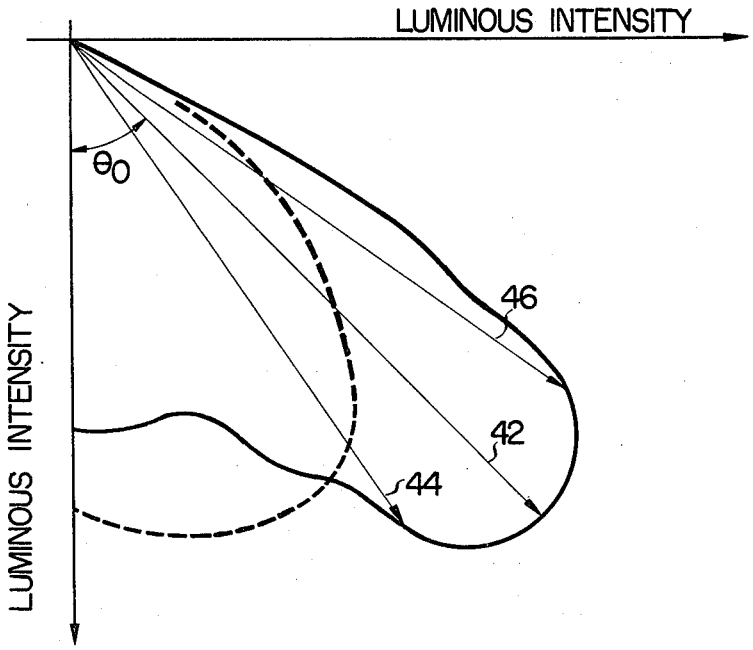
FIG. 4 graphically indicates a luminous intensity distribution characteristic of the lighting device of FIG. 1.

Explanation is now also given with reference to FIG. 4 why an allowable range of errors in the vertical angle $\theta_3$ defined by the third line $l_3$ is chosen to be $\pm 10°$. FIG. 4 graphically indicates a distribution of luminous intensity characteristics of a lighting device of FIGS. 1 to 3 embodying this invention. The graph of FIG. 4 shows that where an angle corresponding to luminous intensity stands at reference vertical angle $\theta_0$, a maximum luminous intensity is ensured as indicated by an arrow 42, enabling the proximity of the front edge 13 of the desk top surface 11 to be optimally illuminated. Where, in FIG. 2, the third line $l_3$ passing along the principal axis of the parabolic cross section of the reflector 22 is rotated downward from the central point 26 of the light source 20, namely, the vertical angle $\theta_3$ defined by the third line $l_3$ becomes smaller than the reference vertical angle $\theta_0$, a direction of maximum luminous intensity is displaced from the front edge 13 of the desk top surface 11 toward the pole braces 16, 17. Therefore, luminous intensity at the front edge 13 is reduced to a degree corresponding to the displacement of the aforementioned direction of maximum luminous intensity. Where the vertical angle $\theta_3$ of the third line $l_3$ is reduced to a level of $0_0-10°$, namely, where the third line $l_3$ is rotated until the arrow 42 denoting the direction of maximum luminous intensity falls on an arrow 44, a direction represented by an arrow 46 is rotated to fall on a direction denoted by the arrow 42 at the front edge 13 of the desk top surface 11. Accordingly, the front edge 13 receives somewhat lower luminous intensity indicated by the arrow 46. However, this reduced luminous intensity indicated by the arrow 46 decreases slightly (for example only 9%) from a maximum luminous intensity represented by the arrow 42. The reason for this is that luminous intensity in the proximity of the region of maximum luminous intensity, (namely, near the apex of the arrow 42) varies in an arcuate form. Where, therefore, the vertical angle $\theta_3$ (FIG. 2) defined by the third line $l_3$ slightly changes within a range extending from the reference vertical angle $\theta_0$ to an angle of $\theta_0-10°$, then, luminous intensity at the front edge 13 of the desk top surface 11 practically does not fall. Therefore, if, in case the third line $l_3$ is rotated upward from the central point 26 of the light source 20, (namely, the vertical angle $\theta_3$ defined by the third line $l_3$ becomes larger than the reference angle $\theta_0$), the vertical angle $\theta_3$ is retained within a range extending from $\theta_0$ to $\theta_0+10°$, then illuminance at the front edge 13 of the desk top surface 11 practically does not decrease. As a result, an allowable range for the vertical angle $\theta_3$ defined by the third line $l_3$ is proved to be $\theta_0 \pm 10°$. (A broken line curve given in FIG. 4 denotes a distribution of illuminance of the conventional lighting device).

Figure 5:
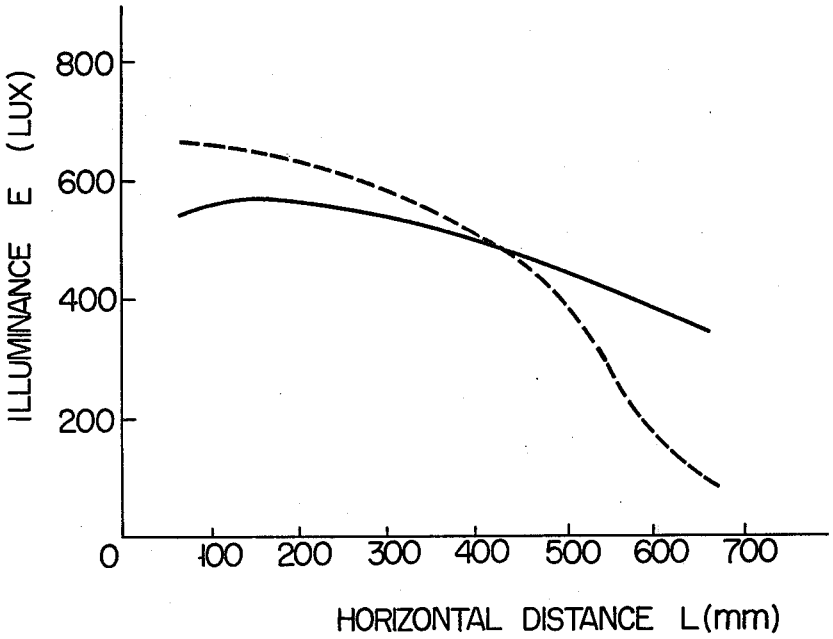
FIG. 5 graphically shows a distribution of illuminance on the desk top surface illuminated by the lighting device of FIG. 1.

With a lighting device embodying this invention which is arranged as described above, part of a light emitted from the light source 20 is conducted through the lower opening 28 of the housing 24 directly to the desk top surface 11. Illuminance on the desk top surface 11 resulting from the directly projected light is distributed in accordance with the inverse square law. Maximum illuminance is ensured at that point on the desk top surface 11 at which a minimum distance is defined between the desk top surface 11 and light source 20, namely, on that portion of the desk top surface 11 which is positioned immediately below the light source. A light issued from the light source and reflected by the reflector 22 is mainly emitted on the front edge 13 of the desk top surface 11. Illuminance on the desk top surface 11 which results from the reflected light is distributed in accordance with the characteristic of luminous intensity distribution graphically shown in FIG. 4. Namely, a maximum amount of reflected light is emitted at the front edge 13 of the desk top surface 11. A distribution of illuminance over the whole area of the desk top surface 11 illuminated by a light emitted from the light source 20 and conducted through the lower opening 28 of the housing 24 is characterized by a solid line curve given in FIG. 5. In other words, the illuminance distribution indicates a substantially flat form. Consequently, the user of a desk provided with such lighting device can perform his duty with good visibility, because that portion of the desk top surface 11 which closely faces him is brightly illuminated. The illuminance curve diagram of FIG. 5 was obtained with a straight tubular 32 W type fluorescent lamp used as a light source 20 with a distance H between the light source 20 and desk top surface 11 to be 620 mm and the crosswise length of an office desk chosen to measure 700 mm. A broken line curve given in FIG. 5 indicates an illuminance distribution related to the conventional lighting device which was determined under the same conditions as used in defining the present invention. With the present lighting device, part of a light emitted from the light source 20 passes through the upper opening 30 of the housing 24 to illuminate, for example, the ceiling of a room in which a desk provided with the lighting device is set. Therefore, luminance distribution throughout the room is noticeably improved, preventing the user's loss of visual acuity from being harmfully affected by the localized or restricted illuminance distribution in an interior.

Another advantage of this invention is to provide a compact illumination device which prevents loss of illuminating property. Where the crosswise length of the rectangular housing 24 increases, then the lower opening 28 of the housing 24 is broadened. An amount of a light increased by the broadened lower opening 28 is completely diverted from the front edge 13 to be wastefully emitted only on the user himself, failing to improve luminous intensity distribution over the desk top surface 11. Conversely where the crosswise length of the rectangular housing 24 is shortened, the resultant illumination device can be indeed rendered compact. However, this merit is offset by the fact that the front end 29 enters a light path defined by the first line $l_1$ of FIG. 3 to an extent corresponding to the above-mentioned reduction in the crosswise length of the rectangular lower opening 28, and consequently illuminance at the front edge 13 of the desk top surface 11 decreases, thereby adversely affecting illuminance distribution in the proximity of the front edge 13 of the desk top surface 11. The foregoing description referred to the crosswise length of the rectangular housing 24 but the next description is given of the height of the housing 24. Where the housing 24 has a great height, illuminance distribution over the desk top surface 11 is not obviously improved, because the relative positions of the light source 20 and the lower opening 28 of the housing 24 remain unchanged. Conversely where the height of the housing 24 is decreased, and the reflector 22 is reduced in height, then an amount of a light conducted through a light path defined by the second line $l_2$ of FIG. 3 decreases, thereby deteriorating illuminance distribution at the front edge 13 of the desk top surface 11. As previously described, the position of the reflector 22 can be lowered to four-fifths of the preferred height in accordance with an allowable range of errors in the vertical angle $\theta_2$ defined by the second line $l_2$ of FIG. 3. However, this event is not preferred, because if the height of the reflector 22 is defined during the assembly of a desk in accordance with a lower allowable limit of errors imposed on the vertical angle $\theta_2$, then the property of a lighting device is harmfully affected by dimensional variations occurring in assembling a desk. For the reason given above, it is proved that a lighting device embodying this invention can be made compact, insofar as its predetermined illuminating property is not deteriorated. The present lighting device has further advantages that when the user sits in front of a desk 10 his front view is only slightly obstructed by the compact housing 24 and the reduction of raw materials realized with the compact housing 24 reduces its manufacturing cost.

Although the present invention has been shown and described with respect to particular embodiments, nevertheless, various changes and modifications which are obvious to a person skilled in the art to which the invention pertains are deemed to lie within the spirit, scope and contemplation of the invention. For instance, it is not always necessary to provide an upper opening 30 for the housing 24. With the foregoing embodiments, the lower opening 28 of the housing 24 was fitted with a transparent plate-shaped cover 32. However, this cover 32 need not always have a plate-shaped cross section. The cover 32 well serves the purpose, provided it is prepared from such material as does not obstruct the free distribution of a light emitted from a light source and from a reflector. Moreover, it is possible to omit said transparent cover 32, if need arises.

Further, in the embodiment shown in FIGS. 1 to 3, the lighting device 12 is positioned above the rear edge 14 of the desk top surface 11. However, the lighting device may be positioned elsewhere. For example, the lighting device may be mounted above one of side edges of the desk top surface 11. Also, two lighting devices may be positioned above the side edges respectively. Where the lighting device is provided above one of the side edges such as left hand side edge as viewed from the user, the reference vertical angle $\theta_0$ should preferably be set $60° \pm 10°$ since the desk top surface is 1,000 to 1,200 mm long in general. The arrangement described above permits further improving the front view of the user.

We claim:

1. A lighting apparatus for illuminating the surface of a desk top of the type having at least a mutually parallel front edge and a rear edge, comprising:

an elongated housing which is set above the rear edge of said desk top, extending along the rear edge, and includes a light projecting opening formed therein on a side thereof facing the desk top;

a straight cylindrical light source housed in said housing so as to extend lengthwise thereof;

a reflector which has a parabolic cross section housed in said housing and positioned so as to face a backside portion of said light source wherein said light source, said housing, said reflector and said desk top are positioned such that a first vertical angle $\theta_0$ defined by a straight line connecting an axis of said light source and the front edge of said desk top lies in a range of $45° \pm 10°$;

a second vertical angle ($\theta_1$) defined by a straight line passing through a front end of the light-projecting opening and tangentially contacting an upper peripheral surface of said light source lies in a range of $\theta_0 \pm 10°$;

a third vertical angle ($\theta_2$) defined by a straight line passing an upper edge of said reflector and tangentially contacting a lower peripheral surface of said light source lies in a range of $\theta_0 \pm 10°$; and a fourth vertical angle ($\theta_3$) defined by said reflector axis lies in a range of $\theta_0 \pm 10°$.

2. A lighting apparatus according to claim 1, further comprising at least one pipe arm for supporting said housing at a predetermined distance from said desk top surface.

3. A lighting apparatus according to claim 1, further comprising a transparent cover positioned in said light-projecting opening which faces said desk top surface.

4. A lighting apparatus according to claim 1, wherein each of said vertical angles ($\theta_1$), ($\theta_2$) and ($\theta_3$) is substantially equal in value to the first vertical angle ($\theta_0$).

5. A lighting apparatus for illuminating the surface of a desk top having at least a mutually parallel front edge and rear edge, comprising:

an elongated housing set above said rear edge of said desk top, extending along said rear edge, and including a pair of light-producing openings formed therein on an underside and an upperside portion thereof;

a straight cylindrical light source received in said housing in a state extending lengthwise thereof and positioned between said pair of light-projecting openings;

a reflector which has a parabolic cross section received in said housing and so positioned as to face a backside portion of said light source wherein said light source, said housing, said reflector and said desk top which are positioned such that a first vertical angle $\theta_0$ defined by a straight line connecting an axis of said light source and said front edge of said desk top lies in a range of $45° \pm 10°$;

a second vertical angle ($\theta_1$) defined by a straight line passing through a front end of said light-projecting opening and tangentially contacting an upper peripheral surface of said light source lies in a range of $\theta_0 \pm 10°$;

a third vertical angle ($\theta_2$) defined by a straight line passing an upper edge of said reflector and tangentially contacting a lower peripheral surface of said light source lies in a range of $\theta_0 \pm 10°$;

a fourth vertical angle ($\theta_3$) defined by said reflection axis is chosen from a range of $\theta_0 \pm 10°$; and a light diffusing cover positioned in said light-projecting opening on the upperside of said housing.

6. A lighting apparatus according to claim 1, wherein said first vertical angle comprises a 45° angle.

7. A lighting apparatus according to claim 1, wherein said light source further comprises a straight fluorescent lamp.

8. A lighting apparatus according to claim 5, wherein each of said vertical angles ($\theta_1$), ($\theta_2$) and ($\theta_3$) is substantially equal to the first vertical angle ($\theta_0$).

9. A lighting apparatus according to claim 4, wherein said first vertical angle comprises a 45° angle.

10. A lighting apparatus according to claim 4, wherein said light source further comprises a straight fluorescent lamp.

* * * * *